US006474509B1

(12) United States Patent
Prince et al.

(10) Patent No.: US 6,474,509 B1
(45) Date of Patent: Nov. 5, 2002

(54) TOOTHPASTE DISPENSING DEVICE

(76) Inventors: John Prince, 1003 Thicket Way, Decatur, GA (US) 30035; Suzanne Prince, 1003 Thicket Way, Decatur, GA (US) 30035

( * ) Notice: Subject to any disclaimer, the term of this patent is extended or adjusted under 35 U.S.C. 154(b) by 0 days.

(21) Appl. No.: 10/171,938

(22) Filed: Jun. 14, 2002

(51) Int. Cl.[7] ..... B65D 35/34
(52) U.S. Cl. ..... 222/100
(58) Field of Search ..... 222/100

(56) References Cited

U.S. PATENT DOCUMENTS 1,839,542 A 1/1932 Ferguson
2,507,651 A 5/1950 Small
2,822,111 A 2/1958 Tripoli
3,417,902 A 12/1968 Mirka
D227,836 S 7/1973 Roiko
3,917,118 A * 11/1975 Odgen ..... 222/101
4,258,864 A 3/1981 Karamanolis et al.

* cited by examiner

*Primary Examiner*—Philippe Derakshani

(57) ABSTRACT

A toothpaste dispensing device for dispensing toothpaste from a tube of toothpaste. The toothpaste dispensing device includes a housing comprises a perimeter wall defining an interior space of the housing. The housing comprises an access aperture extending through the perimeter wall whereby the access aperture is designed for permitting access into the interior space of the housing. A delivery assembly extends through the perimeter wall of the housing. The delivery assembly is designed for being coupled to a dispensing end of the tube of toothpaste. The delivery assembly is designed for transferring toothpaste squeezed from the tube of toothpaste through the perimeter wall of the housing. A dispensing assembly extends through the perimeter wall of the housing. The dispensing assembly is designed for being coupled to a crimped end of the tube of toothpaste whereby actuation of the dispensing assembly squeezes toothpaste into the delivery assembly.

15 Claims, 4 Drawing Sheets

TOOTHPASTE DISPENSING DEVICE

BACKGROUND OF THE INVENTION

1. Field of the Invention

The present invention relates to dispensing devices and more particularly pertains to a new toothpaste dispensing device for dispensing toothpaste from a tube of toothpaste.

2. Description of the Prior Art

The use of dispensing devices is known in the prior art. U.S. Pat. No. 2,822,111 describes a device for dispensing toothpaste from a tube of tooth paste Another type of dispensing device is U.S. Pat. No. Des, 227,836 showing a tube dispenser. U.S. Pat. No. 1,839,542 has a housing for receiving a tube of toothpaste and a key for rolling the tube of the toothpaste to dispense toothpaste from the tube. U.S. Pat. No. 4,258,864 has a roller that engages the tube of toothpaste and squeezes toothpaste from the tube. U.S. Pat. No. 3,417,902 has a roller that engages a tube from squeezing viscous materials from the tube.

While these devices fulfill their respective, particular objectives and requirements, the need remains for a device that has certain improved features that inhibit the unrolling of the tube after paste has been squeezed from the tube.

SUMMARY OF THE INVENTION

The present invention meets the needs presented above by provides indexing assemblies that engage the rod portion to inhibit the natural tendency the tube to unroll and thus rotate the rod portion in the opposite direction.

Still yet another object of the present invention is to provide a new toothpaste dispensing device that maintains the tube of toothpaste with the dispensing end pointing upward to prevent gravity from drawing the toothpaste out of the tube.

To this end, the present invention generally comprises a housing comprises a perimeter wall. The perimeter wall of the housing defines an interior space of the housing. The housing comprises an access aperture extending through the perimeter wall whereby the access aperture is designed for permitting insertion of the tube of toothpaste into the interior space of the housing. The housing is designed for being secured to a support surface. A delivery assembly extends through the perimeter wall of the housing. The delivery assembly is designed for being coupled to a dispensing end of the tube of toothpaste when the tube of toothpaste is positioned in the interior space of the housing. The delivery assembly is designed for transferring toothpaste squeezed from the tube of toothpaste through the perimeter wall of the housing to be used by a user. A dispensing assembly extends through the perimeter wall of the housing. The dispensing assembly is designed for being coupled to a crimped end of the tube of toothpaste whereby actuation of the dispensing assembly by the user squeezes toothpaste from the tube of toothpaste into the delivery assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
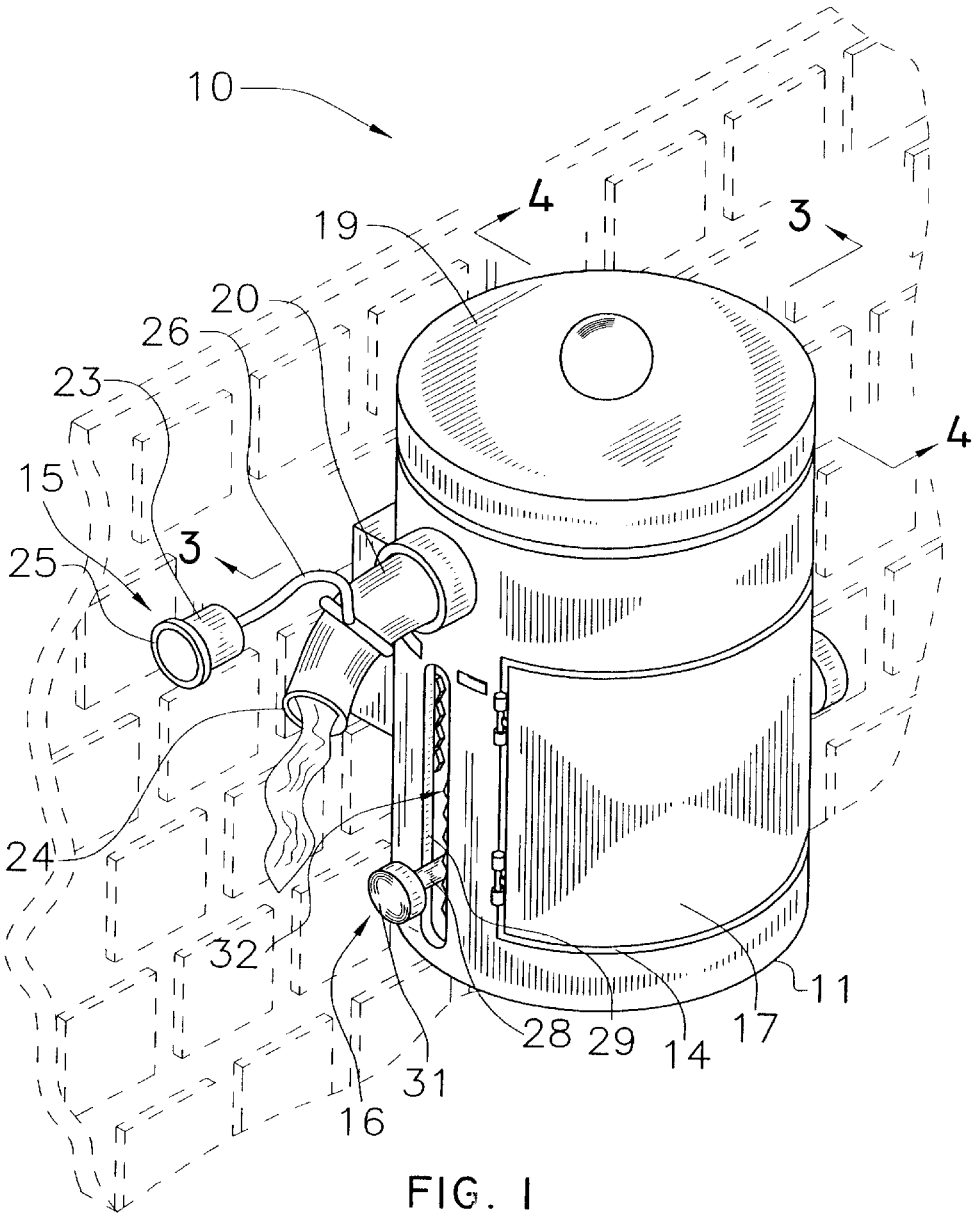
FIG. 1 is a perspective view of a new toothpaste dispensing device according to the present invention shown in use.
Figure 2:
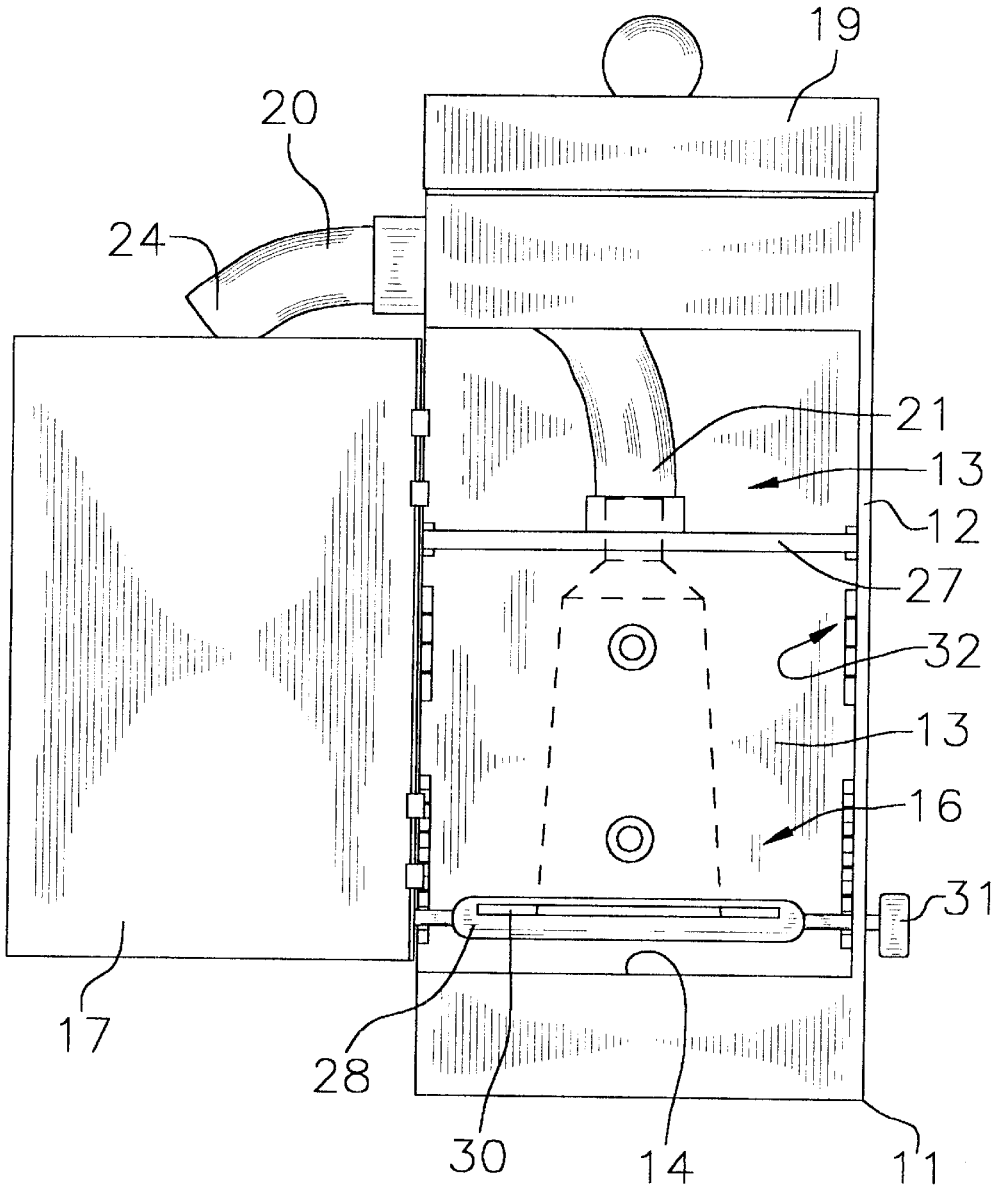
FIG. 2 is a front view of the present invention with the door member in an open position.
Figure 3:
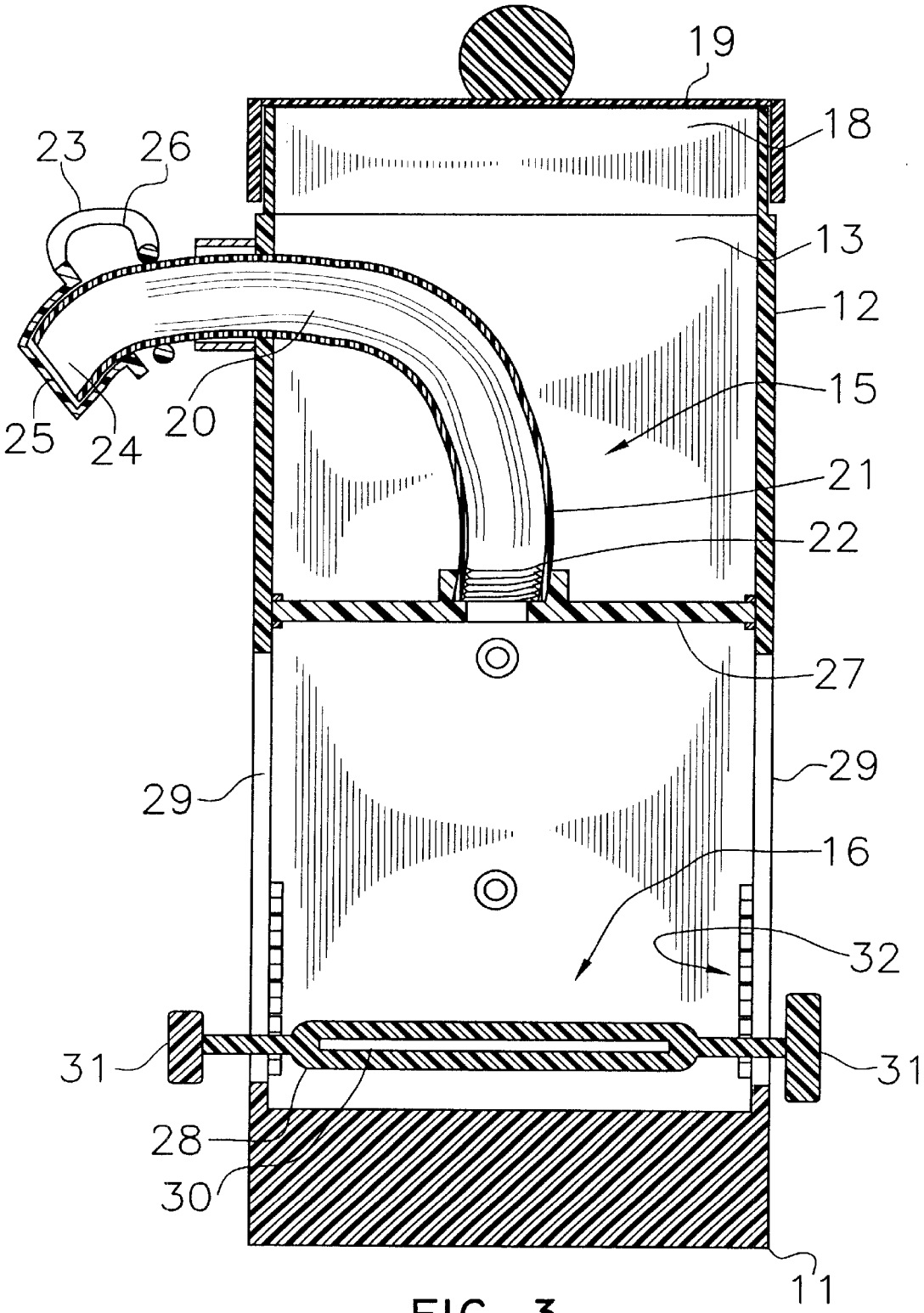
FIG. 3 is a cross-sectional view of the present invention taken along line 3—3 of FIG. 1.
Figure 4:
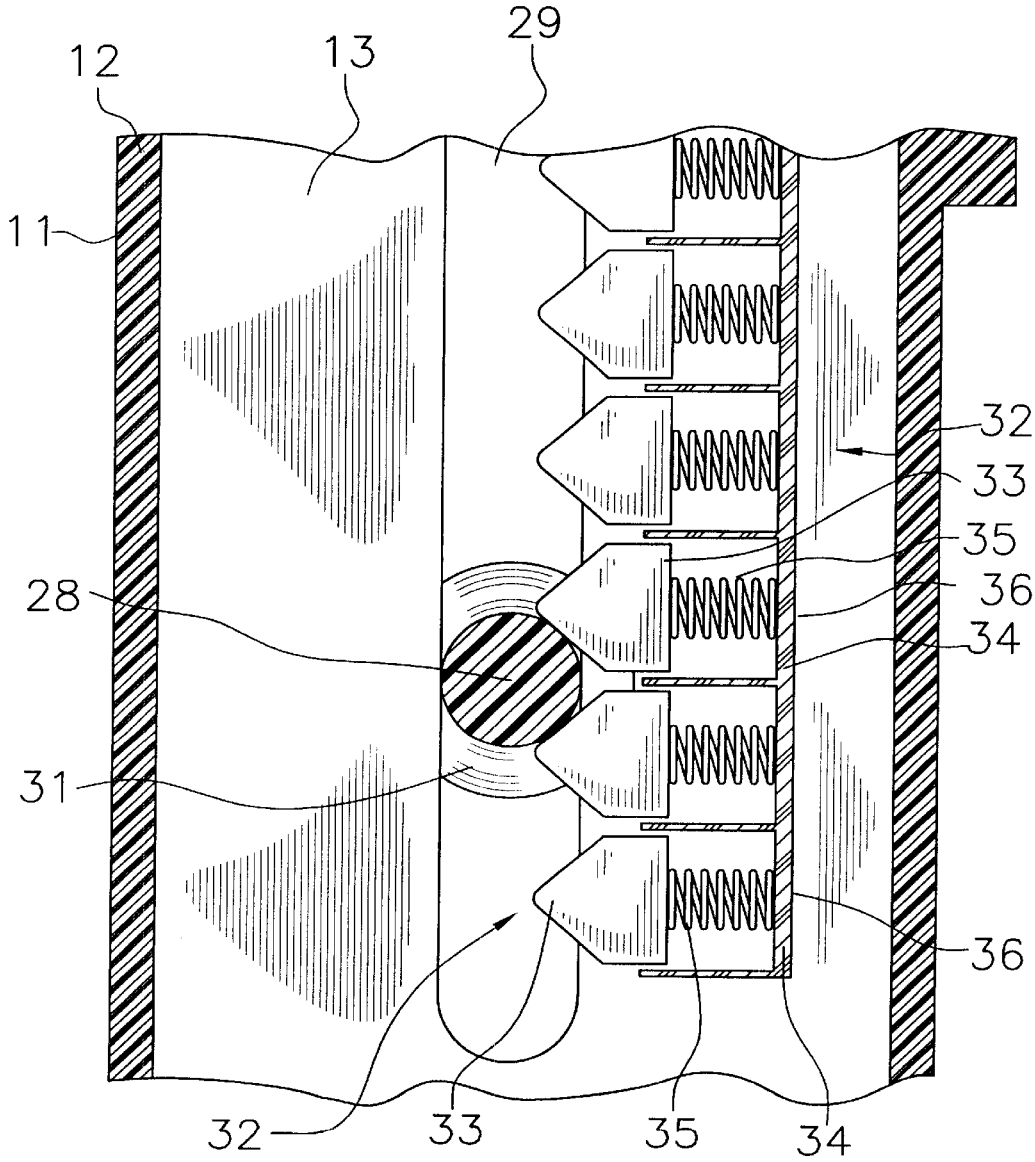
FIG. 4 is a cross-sectional view of the present invention taken along line 4—4 of FIG. 1.

With reference now to the drawings, and in particular to FIGS. 1 through 4 thereof, a new toothpaste dispensing device embodying the principles and concepts of the present invention and generally designated by the reference numeral 10 will be described.

As best illustrated in FIGS. 1 through 4, the toothpaste dispensing device 10 generally comprising a housing 11 comprises a perimeter wall 12. The perimeter wall 12 of the housing 11 defines an interior space 13 of the housing 11. The housing 11 comprises an access aperture 14 extending through the perimeter wall 12 whereby the access aperture 14 is designed for permitting insertion of the tube of toothpaste into the interior space 13 of the housing 11. The housing 11 is designed for being secured to a support surface.

A delivery assembly 15 extends through the perimeter wall 12 of the housing 11. The delivery assembly 15 is designed for being coupled to a dispensing end of the tube of toothpaste when the tube of toothpaste is positioned in the interior space 13 of the housing 11. The delivery assembly 15 is designed for transferring toothpaste squeezed from the tube of toothpaste through the perimeter wall 12 of the housing 11 to be used by a user.

A dispensing assembly 16 extends through the perimeter wall 12 of the housing 11. The dispensing assembly 16 is designed for being coupled to a crimped end of the tube of toothpaste whereby actuation of the dispensing assembly 16 by the user squeezes toothpaste from the tube of toothpaste into the delivery assembly 15. Further, any for of paste material in a flexible tube can be use and dispensed through the delivery assembly 15.

The housing 11 comprises a door member 17. The door member 17 is hingably coupled to the perimeter wall 12 adjacent the access aperture 14 of the housing 11. The door member 17 is for selectively closing the access aperture 14 for restricting access to the interior space 13 of the housing 11 when the door member 17 is positioned over the access aperture 14 of the housing 11.

The interior space 13 of the housing 11 comprises an open top end 18. The open top end 18 of the interior space 13 is designed for permitting water to be introduced into the interior space 13 for washing the interior space 13 of the housing 11.

A cap member 19 selectively engages the housing 11 adjacent the open top end 18 of the interior space 13 of the housing 11. The cap member 19 is for selectively closing the open top end 18 of the interior space 13 of the housing 11 for restricting access to the interior space 13 through the open top end 18 of the interior space 13 of the housing 11 when the cap member 19 engages the housing 11.

The delivery assembly 15 comprises a conduit portion 20. The conduit portion 20 extends through the perimeter wall 12 of the housing 11. The conduit portion 20 is designed for coupling to the dispensing end of the tube of toothpaste whereby toothpaste from the tube of toothpaste progresses through a lumen of the conduit portion 20 to exit the housing 11 when the toothpaste is squeezed from the tube of toothpaste.

The conduit portion 20 of the delivery assembly 15 comprises a proximal end 21. The conduit portion 20 has a plurality of threads 22 positioned in the lumen of the conduit at the proximal end 21 of the conduit whereby the proximal end 21 of the conduit is designed for threadably engaging the dispensing end of the tube of toothpaste.

The delivery assembly 15 comprises a cover portion 23. The cover portion 23 selectively engages a distal end 24 of the conduit opposite the tube of toothpaste. The cover portion 23 is designed for preventing dispensation of the toothpaste from the lumen of the conduit when the cover portion 23 is engaged to the distal end 24 of the conduit.

The cover portion 23 of the delivery assembly 15 comprises a cup member 25 and a tether member 26. The cup member 25 slidably receives the distal end 24 of the conduit in the cup member 25 for inhibiting dispensing of toothpaste from the lumen of the conduit. The tether member 26 selectively engages the conduit and is coupled to the cup member 25 whereby the tether member 26 secures the cup member 25 to the conduit for preventing accidental loss of the cup member 25.

The delivery assembly 15 comprises a securing plate 27. The securing plate 27 is slidably inserted into the interior space 13 of the housing 11. The conduit is coupled to the securing plate 27. The securing plate 27 is designed for selectively engaging the dispensing end of the tube of toothpaste whereby the dispensing end of the tube of toothpaste extends through the securing plate 27 and is engaged by the conduit. The securing plate 27 is designed for securing the tube of toothpaste in the interior space 13 of the housing 11.

The dispensing assembly 16 comprises a rod portion 28. The rod portion 28 extends through a pair of diametrically opposed slots 29 in the housing 11. The rod portion 28 comprises a slit 30 designed for permitting the crimped end of the tube of toothpaste to extend through the rod portion 28 whereby the tube of toothpaste is wound around the rod portion 28 when the rod portion 28 is rotated with respect to the housing 11.

The dispensing assembly 16 comprises a plurality of handle members 31. Each of the handle members 31 is coupled to the rod portion 28 whereby one of the handle members 31 is positioned opposite the other of the handle members 31. Each of the handle members 31 is designed for being engaged by a hand of the user whereby the handle members 31 are for facilitating rotation of the rod portion 28 by the user.

The dispensing assembly 16 comprises a plurality of indexing assemblies 32. Each of the indexing assemblies 32 is coupled to the housing 11 whereby each of the indexing assemblies 32 is positioned in the interior space 13 of the housing 11 adjacent one of the slots 29 in the housing 11. Each of the indexing assemblies 32 selectively engages the rod portion 28 for inhibiting inadvertent sliding in the slot of the housing 11.

Each of the indexing assemblies 32 comprises an indexing member 33. A side of the indexing member 33 engages the rod portion 28 whereby the index member is for restricting inadvertent movement of the rod portion 28 past the indexing member 33 when the rod portion 28 is positioned between the indexing member 33 of an associated one of the indexing assemblies 32 and the indexing member 33 of an adjacent one of the indexing assemblies 32.

Each of the indexing assemblies 32 comprises a receiving portion 34 and a biasing member 35. The receiving portion 34 slidably receives the indexing member 33 of the associated one of the indexing assemblies 32 whereby the receiving portion 34 maintains alignment of the indexing member 33 of the associated one of the indexing assemblies 32 with respect to the associated one of the slots 29 of the housing 11. The biasing member 35 is coupled between the receiving portion 34 and the indexing member 33 of the associated one of the indexing assemblies 32 whereby the biasing member 35 biases the indexing member 33 away from a rear wall 36 of the receiving portion 34 towards the associated one of the slots 29 of the housing 11.

In use, the user removes the securing plate 27 and conduit from the housing 11. The dispensing end of the tube of toothpaste is inserted through the securing plate 27 and threaded onto the conduit. The securing plate 27 and conduit with the tube of toothpaste are inserted into the interior space 13 of the housing 11. The crimped end of the tube of toothpaste is inserted into the slit 30 of the rod portion 28. The cup member 25 is removed from the conduit and the rod portion 28 is rotated to advance toothpaste from the tube of toothpaste into the conduit to be dispensed to the user. The indexing assemblies 32 retaining the rod portion 28 and prevent the rod portion 28 from rotated backwards by expansion of the tube of toothpaste.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toothpaste dispensing device for dispensing toothpaste from a tube of toothpaste, the toothpaste dispensing device comprising:

a housing comprising a perimeter wall, said perimeter wall of said housing defining a n interior space of said housing, said housing comprising an access aperture extending through said perimeter wall such that said access aperture is adapted for permitting insertion of the tube of toothpaste into said interior space of said housing, said housing being adapted for being secured to a support surface;

a delivery assembly extending through said perimeter wall of said housing, said delivery assembly being adapted for being coupled to a dispensing end of the tube of toothpaste when said tube of toothpaste is positioned in said interior space of said housing, said delivery assembly being adapted for transferring toothpaste squeezed from the tube of toothpaste through said perimeter wall of said housing to be used by a user; and a dispensing assembly extending through said perimeter wall of said housing, said dispensing assembly being adapted for being coupled to a crimped end of the tube of toothpaste such that actuation of said dispensing assembly by the user squeezes toothpaste from the tube of toothpaste into said delivery assembly.

2. The toothpaste dispensing device as set forth in claim 1, further comprising:

said housing comprising a door member, said door member being hingably coupled to said perimeter wall adjacent said access aperture of said housing, said door member being for selectively closing said access aperture for restricting access to said interior space of said housing when said door member is positioned over said access aperture of said housing.

3. The toothpaste dispensing device as set forth in claim 1, further comprising:

said interior space of said housing comprising an open top end, said open top end of said interior space being adapted for permitting water to be introduced into said interior space for washing the interior space of the housing.

4. The toothpaste dispensing device as set forth in claim 3, further comprising:

a cap member selectively engaging said housing adjacent said open top end of said interior space of said housing, said cap member being for selectively closing said open top end of said interior space of said housing for restricting access to said interior space through said open top end of said interior space of said housing when said cap member engages said housing.

5. The toothpaste dispensing device as set forth in claim 1, further comprising:

said delivery assembly comprising a conduit portion, said conduit portion extending through said perimeter wall of said housing, said conduit portion is adapted for coupling to the dispensing end of the tube of toothpaste such that toothpaste from the tube of toothpaste progresses through a lumen of said conduit portion to exit said housing when said toothpaste is squeezed from the tube of toothpaste.

6. The toothpaste dispensing device as set forth in claim 5, further comprising:

said conduit portion of said delivery assembly comprising a proximal end, said conduit portion having a plurality of threads positioned in said lumen of said conduit at said proximal end of said conduit such that said proximal end of said conduit is adapted for threadably engaging the dispensing end of the tube of toothpaste.

7. The toothpaste dispensing device as set forth in claim 5, further comprising:

said delivery assembly comprising a cover portion, said cover portion selectively engaging a distal end of said conduit opposite the tube of toothpaste, said cover portion being adapted for preventing dispensation of the toothpaste from said lumen of said conduit when said cover portion is engaged to said distal end of said conduit.

8. The toothpaste dispensing device as set forth in claim 7, further comprising:

said cover portion of said delivery assembly comprising a cup member and a tether member, said cup member slidably receiving said distal end of said conduit in said cup member for inhibiting dispensing of toothpaste from said lumen of said conduit, said tether member selectively engaging said conduit and being coupled to said cup member such that said tether member secures said cup member to said conduit for preventing accidental loss of said cup member.

9. The toothpaste dispensing device as set forth in claim 5, further comprising:

said delivery assembly comprising a securing plate, said securing plate being slidably inserted into said interior space of said housing, said conduit being coupled to said securing plate, said securing plate being adapted for selectively engaging the dispensing end of the tube of toothpaste such that the dispensing end of the tube of toothpaste extends through said securing plate and is engaged by said conduit, said securing plate being adapted for securing the tube of toothpaste in said interior space of said housing.

10. The toothpaste dispensing device as set forth in claim 1, further comprising:

said dispensing assembly comprising a rod portion, said rod portion extending through a pair of diametrically opposed slots in said housing, said rod portion comprising a slit adapted for permitting the crimped end of the tube of toothpaste to extend through said rod portion such that the tube of toothpaste is wound around said rod portion when said rod portion is rotated with respect to said housing.

11. The toothpaste dispensing device as set forth in claim 10, further comprising:

said dispensing assembly comprising a plurality of handle members, each of said handle members being coupled to said rod portion such that one of said handle members is positioned opposite the other of said handle members, each of said handle members being adapted for being engaged by a hand of the user such that said handle members are for facilitating rotation of said rod portion by the user.

12. The toothpaste dispensing device as set forth in claim 10, further comprising:

said dispensing assembly comprising a plurality of indexing assemblies, each of said indexing assemblies being coupled to said housing such that each of said indexing assemblies is positioned in said interior space of said housing adjacent one of said slots in said housing, each of said indexing assemblies selectively engaging said rod portion for inhibiting inadvertent sliding in said slot of said housing.

13. The toothpaste dispensing device as set forth in claim 12, further comprising:

each of said indexing assemblies comprising an indexing member, a side of said indexing member engaging said rod portion such that said index member is for restricting inadvertent movement of said rod portion past said indexing member when said rod portion is positioned between said indexing member of an associated one of said indexing assemblies and said indexing member of an adjacent one of said indexing assemblies.

14. The toothpaste dispensing device as set forth in claim 13, further comprising:

each of said indexing assemblies comprising a receiving portion and a biasing member, said receiving portion slidably receiving said indexing member of the associated one of said indexing assemblies such that said receiving portion maintains alignment of said indexing member of the associated one of said indexing assemblies with respect to the associated one of said slots of said housing, said biasing member being coupled between said receiving portion and said indexing member of the associated one of said indexing assemblies such that said biasing member biases said indexing member away from a rear wall of said receiving portion towards the associated one of said slots of said housing.

15. A toothpaste dispensing device for dispensing toothpaste from a tube of toothpaste, the toothpaste dispensing device comprising:

a housing comprising a perimeter wall, said perimeter wall of said housing defining an interior space of said housing, said housing comprising an access aperture extending through said perimeter wall such that said access aperture is adapted for permitting insertion of the tube of toothpaste into said interior space of said housing, said housing being adapted for being secured to a support surface;

a delivery assembly extending through said perimeter wall of said housing, said delivery assembly being adapted for being coupled to a dispensing end of the tube of toothpaste when said tube of toothpaste is positioned in said interior space of said housing, said delivery assembly being adapted for transferring toothpaste squeezed from the tube of toothpaste through said perimeter wall of said housing to be used by a user;

a dispensing assembly extending through said perimeter wall of said housing, said dispensing assembly being adapted for being coupled to a crimped end of the tube of toothpaste such that actuation of said dispensing assembly by the user squeezes toothpaste from the tube of toothpaste into said delivery assembly;

said housing comprising a door member, said door member being hingably coupled to said perimeter wall adjacent said access aperture of said housing, said door member being for selectively closing said access aperture for restricting access to said interior space of said housing when said door member is positioned over said access aperture of said housing;

said interior space of said housing comprising an open top end, said open top end of said interior space being adapted for permitting water to be introduced into said interior space for washing the interior space of the housing;

a cap member selectively engaging said housing adjacent said open top end of said interior space of said housing, said cap member being for selectively closing said open top end of said interior space of said housing for restricting access to said interior space through said open top end of said interior space of said housing when said cap member engages said housing;

said delivery assembly comprising a conduit portion, said conduit portion extending through said perimeter wall of said housing, said conduit portion is adapted for coupling to the dispensing end of the tube of toothpaste such that toothpaste from the tube of toothpaste progresses through a lumen of said conduit portion to exit said housing when said toothpaste is squeezed from the tube of toothpaste;

said conduit portion of said delivery assembly comprising a proximal end, said conduit portion having a plurality of threads positioned in said lumen of said conduit at said proximal end of said conduit such that said proximal end of said conduit is adapted for threadably engaging the dispensing end of the tube of toothpaste;

said delivery assembly comprising a cover portion, said cover portion selectively engaging a distal end of said conduit opposite the tube of toothpaste, said cover portion being adapted for preventing dispensation of the toothpaste from said lumen of said conduit when said cover portion is engaged to said distal end of said conduit;

said cover portion of said delivery assembly comprising a cup member and a tether member, said cup member slidably receiving said distal end of said conduit in said cup member for inhibiting dispensing of toothpaste from said lumen of said conduit, said tether member selectively engaging said conduit and being coupled to said cup member such that said tether member secures said cup member to said conduit for preventing accidental loss of said cup member;

said delivery assembly comprising a securing plate, said securing plate being slidably inserted into said interior space of said housing, said conduit being coupled to said securing plate, said securing plate being adapted for selectively engaging the dispensing end of the tube of toothpaste such that the dispensing end of the tube of toothpaste extends through said securing plate and is engaged by said conduit, said securing plate being adapted for securing the tube of toothpaste in said interior space of said housing;

said dispensing assembly comprising a rod portion, said rod portion extending through a pair of diametrically opposed slots in said housing, said rod portion comprising a slit adapted for permitting the crimped end of the tube of toothpaste to extend through said rod portion such that the tube of toothpaste is wound around said rod portion when said rod portion is rotated with respect to said housing;

said dispensing assembly comprising a plurality of handle members, each of said handle members being coupled to said rod portion such that one of said handle members is positioned opposite the other of said handle members, each of said handle members being adapted for being engaged by a hand of the user such that said handle members are for facilitating rotation of said rod portion by the user;

said dispensing assembly comprising a plurality of indexing assemblies, each of said indexing assemblies being coupled to said housing such that each of said indexing assemblies is positioned in said interior space of said housing adjacent one of said slots in said housing, each of said indexing assemblies selectively engaging said rod portion for inhibiting inadvertent sliding in said slot of said housing;

each of said indexing assemblies comprising an indexing member, a side of said indexing member engaging said rod portion such that said index member is for restricting inadvertent movement of said rod portion past said indexing member when said rod portion is positioned between said indexing member of an associated one of said indexing assemblies and said indexing member of an adjacent one of said indexing assemblies; and each of said indexing assemblies comprising a receiving portion and a biasing member, said receiving portion slidably receiving said indexing member of the associated one of said indexing assemblies such that said receiving portion maintains alignment of said indexing member of the associated one of said indexing assemblies with respect to the associated one of said slots of said housing, said biasing member being coupled between said receiving portion and said indexing member of the associated one of said indexing assemblies such that said biasing member biases said indexing member away from a rear wall of said receiving portion towards the associated one of said slots of said housing.

* * * * *